United States Patent [19]

Right

[11] 4,118,694

[45] Oct. 3, 1978

[54] BASE LOOP CODE TRANSMITTER

[75] Inventor: Robert W. Right, Huntington, Conn.

[73] Assignee: General Signal Corporation, Rochester, N.Y.

[21] Appl. No.: 792,154

[22] Filed: Apr. 29, 1977

[51] Int. Cl.[2] ..... G08B 25/00

[52] U.S. Cl. ..... 340/293; 340/287; 340/506; 340/635

[58] Field of Search ..... 340/293, 164 R, 167 R, 340/168 R, 213 R, 287, 409

[56] References Cited

U.S. PATENT DOCUMENTS

| | | | |
|---|---|---|---|
| 3,085,235 | 4/1963 | Ward | 340/293 |
| 3,686,668 | 8/1972 | Durkee | 340/293 |
| 3,701,141 | 10/1972 | Andrews | 340/293 |
| 3,852,718 | 12/1974 | Delyria | 340/293 |
| 3,883,866 | 5/1975 | Kneeland | 340/293 |

*Primary Examiner*—Harold I. Pitts
*Attorney, Agent, or Firm*—Milton E. Kleinman; John Ohlandt

[57] ABSTRACT

A solid state code transmitter adapted for use with a conventional local fire alarm system in connection with installations that include a McCulloh loop circuit for the transmission of signals to a central proprietary fire alarm surveillance point. The transmitter circuit generates an electronic data word 17 bits long, the first 14 bits being field programmable by way of miniature DIP switches, each data word representing an equivalent of one round of generated code. During an ALARM input the transmitter circuit will generate four rounds of code, and will further generate one round when the ALARM input is removed; during a TROUBLE input, the circuit will generate two rounds of code and one round when that TROUBLE input is removed; during simultaneous ALARM and TROUBLE inputs, ALARM will take precedence; however, a one round restoration code will not be generated if either ALARM or TROUBLE inputs remain active while the other is removed, and upon removal of a second input (ALARM or TROUBLE), a one round restoration code will be generated.

8 Claims, 4 Drawing Figures

BASE LOOP CODE TRANSMITTER

BACKGROUND, OBJECTS AND SUMMARY OF THE INVENTION

The present invention relates to fire alarm systems and particularly to a unique code transmitter for use with a type of fire alarm system that involves a so-called McCulloh loop circuit.

The device and associated apparatus of the present invention is readily adapted to serve with presently available low voltage fire alarm systems. These systems are typically electrically supervised, zoned, local fire alarm systems with provisions for transmitting a coded signal over a base loop circuit to a central fire headquarters. Also, such systems typically receive alarm signals from remote monitoring units which are connected into electrically supervised initiating circuits and provides audible and visual indications of such conditions.

One of the important functions of the aforedescribed fire alarm system is to operate an alarm to energize or de-energize control equipment for other electrical systems in the building. Typical examples of application are for the purpose of turning off ventilating or airconditioning systems, automatically closing fire doors, etc., when an alarm is sounded.

There are generally three basic modes of operation of the system described above: the supervisory or normal condition; the ALARM condition; and the TROUBLE condition. In addition, such a system can also include facilities for a so-called "test" condition. The way in which such a system operates is that when 24 volt AC power is applied, with no alarms in progress and the TROUBLE signal silent, the system is in the supervisory mode of operation, this being the normal condition. As long as this condition prevails, the system requires no attention or routine servicing.

In the ALARM mode of operation, the sounding of a continuous general evacuation alarm results from the pulling down of a box lever at any manual box station or the operation of any automatic fire detector. Alarm signals continue until the station or detector from which the alarm originated is restored to the normal condition and the reset button on the control panel is pressed. Simultaneously with the sounding of the general alarm, a four round coded signal is transmitted over a base loop circuit to a central fire headquarters and the trouble signal sounds continuously. Concurrently a fan shutdown relay is energized such that its contacts function to energize or de-energize other electrical circuits in the building such as ventilating, airconditioning, etc.

The TROUBLE mode of operation eventuates when any electrical fault develops in the system that would prevent the sounding of an alarm. In such case the system TROUBLE signal sounds a continuous trouble warning signal and one round of TROUBLE code is transmitted over the base loop to the central fire headquarters.

Forming part of the aforenoted system is a code transmitter which is a spring driven, electrically released mechanism capable of transmitting 40 full rounds of code on one full winding of spring. The coding mechanism consists of a spring driven clock escapement that, through appropriate gearing, drives a coding wheel and a face cam at a five to one ratio. The escapement mechanism is controlled by two interconnecting arms, one actuated by the trip coil, the other by a pawl riding into and out of detents in the cam. Complete details on such a code transmitter may be obtained by reference to the aforenoted Catalog No. 1308 of the Edwards Company.

The code transmitter functions in connection with a McCulloh loop circuit, such circuit providing for the ability of the system to receive an alarm, even though the fire alarm circuit may be open because of some fault in the box circuit wiring. Such McCulloh loop circuit will be described in some detail hereinafter. Suffice it to say at this point that the technique of the McCulloh loop circuit is to provide operation even though there is an open, by using the remaining good leg of the circuit and ground return.

The response at the control panel to a fault can be either automatic or manual. When automatic, relays perform the conditioning function; when manual, a switch must be manually operated. The automatic grounding type system is free of circuit grounds until a break occurs. The relays then de-energized on both sides of the line are tied together (via the relay contacts) at the positive terminal of the power supply. At the same time, the negative side of the power supply is grounded. In the event of an alarm under these existing conditions, the fire alarm box mechanism will transmit its signal from the positive line via the signaling contacts to the signal responsive devices at the control panel through ground return to the negative power source. Both boxes and the central control panel must be designed for and be compatible with this type of operation under an open circuit fault.

Although the above described schemes and arrangements involving McCulloh loop circuits and the like have their purposes and uses, it has become desirable to provide greater flexibility in the performance of fire alarm systems and more specifically to allow for field programmable arrangements such that the modes and types of operations and the particular character of code signals can be altered or modified by the customer.

Accordingly, it is a primary object of the present invention to provide an extremely flexible code transmitting apparatus or system which eliminates the mechanical parts involved in code transmitters heretofore known, particularly avoiding the need for winding up a spring actuated device.

Another primary object of the present invention is to avoid the ambiguity that is often present when a variety of alarm or trouble conditions occur simultaneously or with only a very slight time gap between their occurrences such that the code signals generated by a first condition can be confused with those generated by a second condition. In other words, the coded signals of the present invention which define particular individual modes and combinations of modes of operation are clear and unambiguous and allow the operator at a central headquarters to identify without doubt the particular condition to which the system is responding.

Another object is to enable the system to shift to particular priorities, that is, for example, to give precedence to one transmitter over another; or to indicate a particular condition such as an ALARM condition which should take priority over, for example, a TROUBLE condition, and to do this immediately, without having to wait for a mechanical code transmitter to go through its entire cycle.

Another object is to reduce the cost of the code transmitting system by fully implementing such a system with integrated circuits and the like which have been reduced substantially in cost in recent years.

In fulfillment of certain of the above stated objects, a primary feature of the present invention resides in the provision of a unique relay contact/diode arrangement for connection to the McCulloh loop circuit. This arrangement takes the place of the former mechanical type of code wheel or code mechanism.

A further feature of the present invention resides in the provision of a generated code for pulsing the relay contact/diode arrangement within the loop such that multiple code transmitters can be operated over the same McCulloh loop.

Other and further objects, advantages and features of the present invention will be understood by reference to the following specification in conjunction with the annexed drawing, wherein like parts have been given like numbers.

DESCRIPTION OF PREFERRED EMBODIMENT

Figure 1:
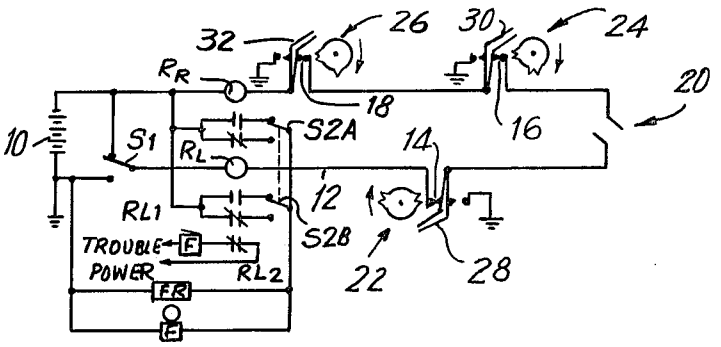
FIG. 1 PRIOR ART
FIG. 1 is a schematic diagram of a prior art McCulloh loop circuit, illustrating the use of code wheel mechanisms.

Referring now to the figures of the drawing and particularly for the moment to FIG. 1, there is illustrated therein a McCulloh loop circuit known in the prior art, more particularly such a loop circuit involving what is known as class A circuit operation. Under such operation, the circuit operates from a grounded positive battery supply 10. The negative ungrounded side feeds through the right-hand circuit relay (one leg of a closed series loop) out through the signal line 12 to the several alarm box signaling contacts 14, 16, 18; thence back through the left-hand ground relay and return to ground by way of switch S1 which is normally in the downward position.

It should also be noted that, rather than as specifically shown in FIG. 1, the switch contacts S2A and S2B are normally in the downward position; and also, in the normal state or condition, the relay contacts of the left-hand and right-hand circuit relays are opposite from what is shown in FIG. 1. However, under the "open fault" condition illustrated, both the left-hand and right-hand circuit relays, that is, relays $R_L$ and $R_R$, are both released and their contacts assume the conditions as indicated in FIG. 1. The circuit at this point is either automatically or manually switched, by way of operation of switches S1 and S2A and S2B so that the battery 10 may feed out through both relays to the open fault, such being indicated at 20. There are thus formed two normally-open circuits which will receive signals from the ground contact of the fire alarm boxes or transmitters 22, 24 and 26. Each box or transmitter 22, 24 or 26 is equipped with a set of contacts known as "McCulloh brush" and consisting of several contact fingers as seen in FIG. 1, that is, fingers 28, 30 and 32 which are held together to form a closed circuit and an open circuit. Two of the contact fingers are electrically common but are arranged to flex separately.

For proper Class A action of the McCulloh loop, the opening and grounding functions of the circuit must be independent of each other. This is accomplished by staggering the open and ground contact blades 28, 30 and 32 of the respective transmitters 22, 24 and 26 so that each code wheel tooth will open the line, close the line and then ground the line. If the line does not close before the ground contact is made, the ground signal will not return both ways, and the signal will be lost under some conditions. Class A circuits require the McCulloh brush type contact action at the fire alarm transmitter to be compatible with the associated control unit.

Figure 2:
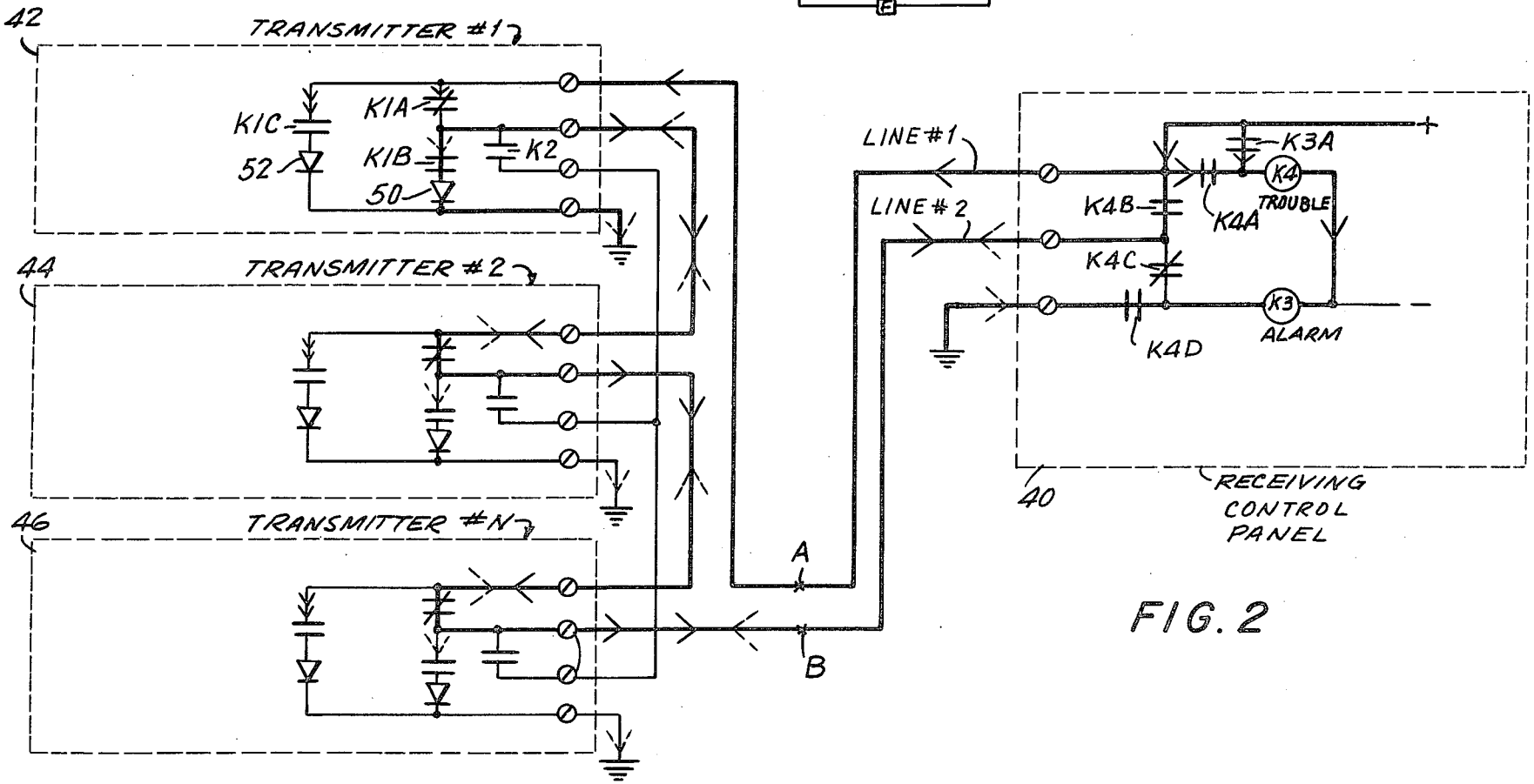
FIG. 2 is a block-schematic diagram of a McCulloh loop circuit in which the unique relay contact/diode arrangement of the present invention is included, and in which particular faults are illustrated.

Referring now to FIG. 2 of the drawing, there will be seen a McCulloh loop circuit according to which a plurality of transmitters designated transmitter No. 1, No. 2 and No. N are connected by way of two lines designated line No. 1 and line No. 2 to a receiving control panel 40, typically located at a central fire headquarters or the like. In FIG. 2 only the output portion of each of the code transmitters is shown in each of the boxes designated 42, 44, 46; however, it will be understood that the logic scheme illustrated in FIG. 4 is also incorporated within each of the boxes 42, 44 and 46.

Figure 4:
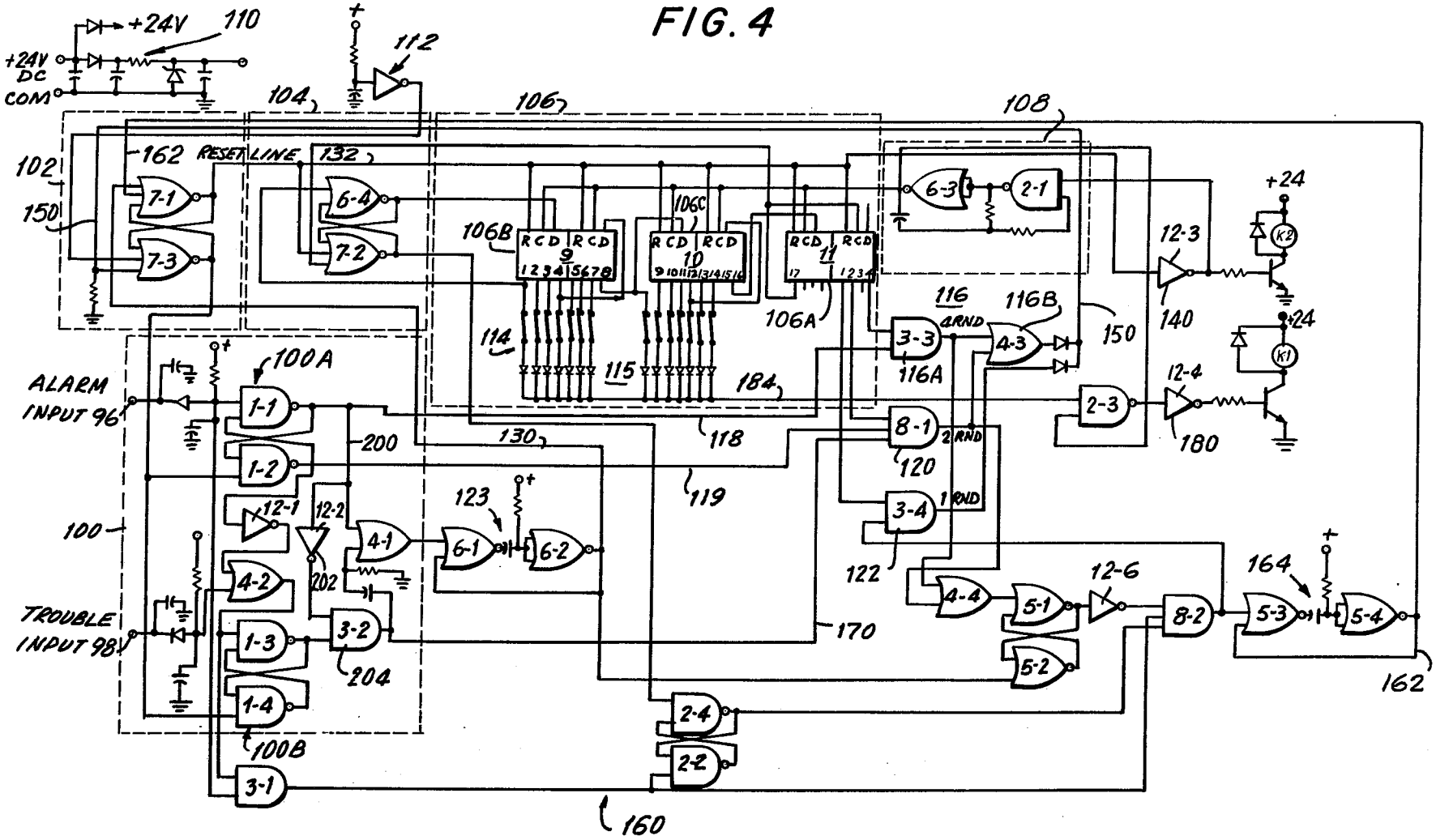
FIG. 4 is a block-schematic diagram, especially illustrating the logic scheme which is operative to produce the varied coding for the code transmitter of the present invention.

The arrangement at the output end includes a plurality of relay contacts K1A, K1B and K1C which are the contacts of code relay K1 shown in FIG. 4. Also appearing at the output is a relay contact K2 which is denominated a shunt relay contact, the relay K2 also being seen in FIG. 4. The relay K1 is denominated a code relay for reasons which will become apparent. The pair of relay contacts K1A and K1B in each of the transmitters 1, 2 and N is connected in series to ground by way of a diode 50; another diode 52 is connected in series with the relay contact K1C.

At the receiving control panel 40, located at the central station, a pair of relays K3 and K4 are provided. Relay K3 is known as an ALARM relay and K4 is a TROUBLE relay; the former codes the alarm which is to be given, whereas the other relay is responsive to trouble conditions and has a time delay pull-in. The several contacts for each of the relays are shown within the block 40; in particular, a first of these contacts K3A is connected to a source of positive potential (+) and, in series with the TROUBLE relay, to a source of negative supply. Contact K4A is a self-latching contact for relay K4 and is connected in shunt with contact K3A. Contacts K4B and K4C are connected directly between the positive and negative voltage supplies and the junction between them is connected to line 2, while line 1 is connected by way of terminal A to the positive side of contact K4B. Contact K4D is connected through the ALARM relay K3 to the negative supply and also to contact K4C; its other end is connected directly to ground.

When both of the lines 1 and 2 are intact, it will be appreciated that current flows over these lines from the central battery supply as indicated by the solid arrows. Thus current flows out from the central station by way of line 1, thence through the normally closed contacts K1A of each of the transmitters in series (relays K1 being unenergized). Current flow, of course, is returned by way of line 2 from the last of the transmitters, that is, transmitter No. N, being able to flow by way of normally closed contact K4C (relay K4 being unenergized at this point), thence through ALARM relay K3 to the negative supply.

However, let it be assumed that line No. 1 for some reason becomes open, as at point A seen in FIG. 2, then current will no longer be able to flow over line 1 to the various transmitters. Instead, current flow will be as indicated by the dotted arrows throughout. Accordingly, due to the open line, the normally energized K3 relay will become de-energized and this will result in closure of contacts K3A which in turn results in pulling in of relay K4 after sufficient time delay. Consequently, the contacts K4B will now close and current flow will be enabled over line 2 in the direction indicated by the dotted arrow, the return path being by ground in the event that any of the individual code relay contacts K1B at the various transmitters have become closed. In other words, the transmission loop becomes a normally open loop, being closed intermittently in response to the initiation of the coded alarm which acts to close the contact K1B, thus enabling current flow to ground at each of the transmitters.

It will be apparent that the return flow by way of ground is continued to the negative supply by reason of the fact that relay contact K4D at the central station has closed due to the energization of TROUBLE relay K4. At the same time, contact K4C has opened so as to prevent any short-circuiting. It will also be appreciated that TROUBLE relay K4, because it is provided with the self-latching contact K4A, will be kept in its energized state.

On the other hand, should line No. 2 become open, as at point B, such that no current flow is possible over this line, the transmission loop will be operative with current flow as before over line 1 to each of the transmitters; however, in this case another normally open path will be available to ground at each of the transmitters, such availability being indicated by the double arrow above the contacts K1C. Thus, the system will operate as before when line 1 was open, i.e., in the respect that the return will again be by way of ground back to the central station and the coding will be carried out by dint of repetitive closing of the K1C contacts.

It should be noted that the reason that either an open or closed loop can be operative for coding purposes is that the alarm device at the central station is a single stroke device which can operate in either case, that is, whether the coding is by way of a normally open contact or by way of a normally closed contact or contacts. It should also be noted that in the illustrative example of FIG. 2 it was assumed that only one of the transmitters, that is, transmitter No. 1, was considered as being active as indicated by the word "active" within the box 12. However, if two transmitters become active, there will be interference between the codes transmitted by them; i.e., in the cases just noted where either line is open.

Figure 3:
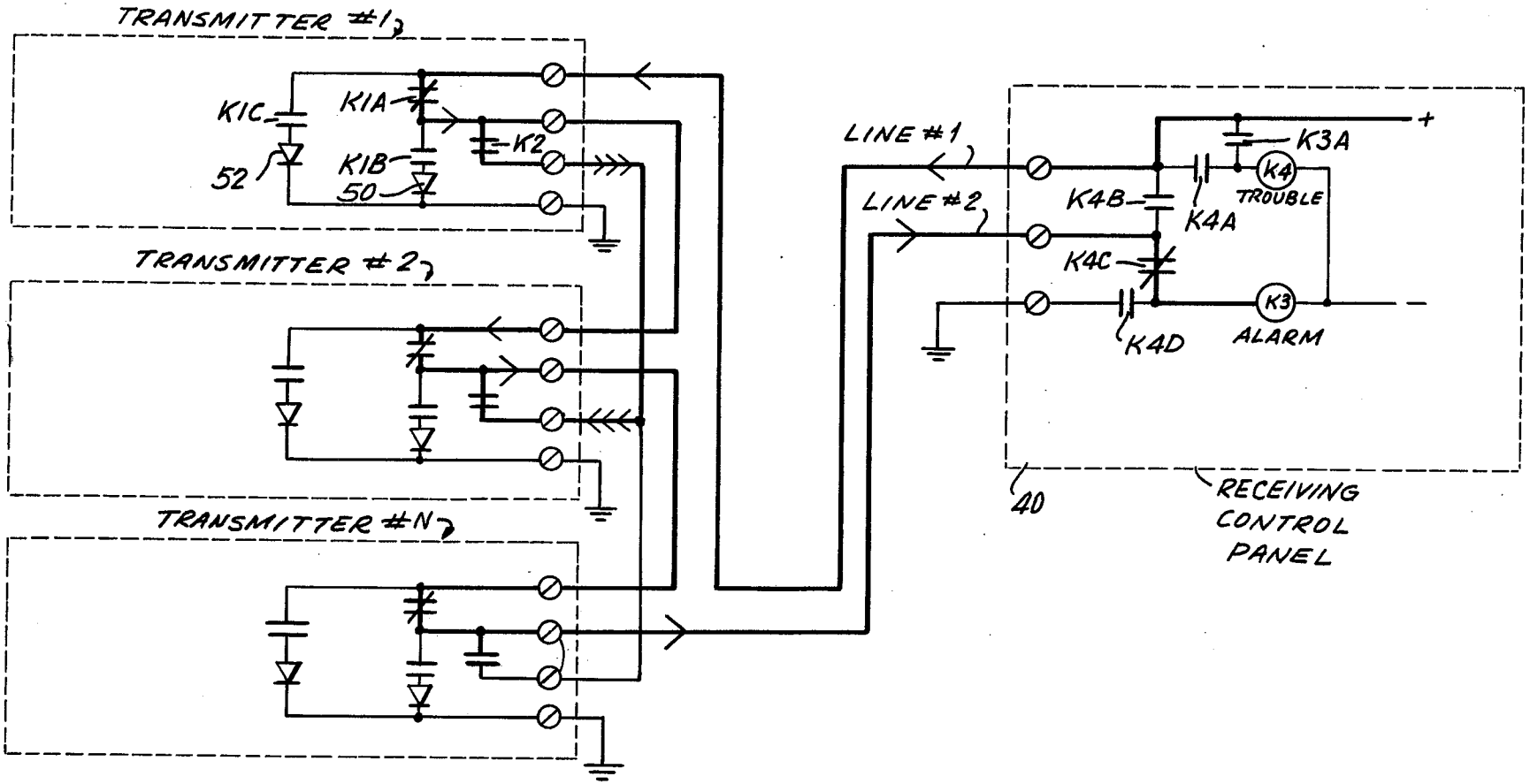
FIG. 3 is a schematic diagram of a McCulloh loop circuit, similar to that shown in FIG. 2, but in which two active transmitters are illustrated.

Turning now to FIG. 3, the McCulloh loop previously illustrated in FIG. 2 is repeated herein. However, in this case two of the transmitters, namely, transmitters No. 1 and No. 2, are both considered to be active or capable of being activated. In the simple case previously illustrated in FIG. 2, it was assumed that coding would proceed by way of contact K1A in the event that both of the lines 1 and 2 had preserved their integrity or such coding would proceed by way of open contacts K1B or K1C in the event that line 1 or line 2 were, respectively, open. Here in FIG. 3 the situation is that both transmitters 1 and 2 may be desirous of transmitting a code. However, the shunting contacts K2 prevent this. The arrangement is such that the shunting contact K2 on transmitter 1 will prevent the coding of transmitter 2. In other words, transmitter No. 1 is given the highest priority, it being the station to which line 1 is first connected, connection therefrom being made to the succeeding transmitters. This priority is established by the shunting which acts to prevent the coding of transmitter 2 because of the short circuit path established when transmitter No. 2 trys to transmit code. Thus, if transmitter 1 is already in the transmission state its shunt contact K2 will have closed. Then, when transmitter No. 2 trys to transmit, its shunt contact k2 will also close due to energization of its relay K2 and the normal path of current flow through the normally operative code contact K1A at transmitter No. 2 will become short circuited. This short circuited path can be seen by following the group of three arrows from the first shunt contact K2 through the second shunt contact.

In FIG. 4 there is illustrated the logic scheme or arrangement for each of the aforenoted code transmitters. Thus there is shown in this figure all of the solid state integrated circuits and other components that make up the transmitter except for the relay contacts which were previously described in connection with the McCulloh loop circuit in FIG. 3.

While the logic scheme or arrangement of the present invention could be implemented with a wide variety of components—and, in fact, could be implemented by means of a microprocessor or like device, it is contemplated that off-the-shelf integrated circuits would be used. Thus, suitable integrated circuits obtainable, for example, from RCA-IC manual SSB-210 dated April 1976 could be utilized. However, since the details of such integrated circuits are well documented in the RCA manual, as well as other manufacturers' manuals, these will not be presented in detail. However, it should be particularly noted that a typical integrated circuit manufactured by RCA and known as the CD-4011 could be utilized in the first or initiating stage of the logic arrangement. This integrated circuit has four sections and these are labeled 1-1, 1-2, 1-3 and 1-4 in the lower left portion of the block-schematic of FIG. 4. Other integrated circuits are similarly labeled so that the man skilled in the art could easily fabricate the scheme depicted in FIG. 4 by interconnecting such standard integrated circuits. More particularly, those integrated circuits identified by a three as their first digit comprise RCA integrated circuit 4081; by a four, CD-4071; five and six, CD-4001; seven, CD-4025; eight, CD-4073; nine, 10 and 11, CD-4015; and 12, CD-4099.

Before proceeding with a description of the operation of the logic arrangement of FIG. 4, it is well to consider the advantages attendant upon the FIG. 4 implementation, that is, the solid state implementation of a transmitter designed to transmit varying numbers of rounds of code, as contrasted with a mechanical code transmitter. For purposes of comparison, a table is herewith furnished which lists the number of rounds involved in the different modes of operation of a mechanical code transmitter and the solid state transmitter in accordance with the invention.

TABLE

| | Condition | Number of Rounds | |
|---|---|---|---|
| | | Mechanical | Solid State |
| Basic 1 | Alarm | 4 | 4 |
| 2 | Trouble | 1 | 2 |

TABLE-continued

| | Condition | Number of Rounds Mechanical | Number of Rounds Solid State |
|---|---|---|---|
| Modes 3 | Alarm Restoration | ① | 1 |
| 4 | Trouble Restoration | 4 | 1 |
| 5 | a) Momentary alarm removed during first round | ① | 5 |
| | b) Momentary alarm removed after first round | 5 | 5 |
| 6 | a) Momentary trouble | ① | 3 |
| | b) Alarm after one trouble round | 3 | 4 |
| 7 | a) Momentary alarm - then constant trouble before first round complete | ① | 6 |
| | b) Momentary alarm - then constant trouble after first round complete | 5 | 6 |
| 8 | Momentary trouble - then constant alarm before trouble round complete | 4 | 4 |
| 9 | Momentary alarm - then momentary trouble removed after five rounds | ① Never reaches five rounds | 6 |
| 10 | Momentary alarm and momentary trouble removed before five rounds | ① | 5 |

A cursory examination of the table will reveal that the mechanical transmitter is open to a number of ambiguities and it will be apparent, for example, that one round of code transmitted thereby may be interpreted as either trouble, momentary trouble, momentary alarm, or alarm restoration as indicated by the circled number "1" in the table. Likewise, four rounds of code may be interpreted as either an alarm condition or the trouble restoration mode of operation. On the other hand, the table makes clear that the transmitter of the invention substantially eliminates such ambiguities. Moreover, as will be explained fully hereinafter, the solid state logic arrangement of the present invention makes possible instantaneous change-over from the transmission of a code representing the TROUBLE condition to the transmission of a code representing the ALARM condition. Accordingly, it is not necessary to wait for a pre-set mechanical device to "grind through" a particular number of rounds of code before changing to the number of rounds representing the ALARM condition. Thereby, in this particular instance, an immediate priority is established for the ALARM condition.

In FIG. 4 there is shown a complete block diagram for the logic scheme or arrangement. The basic inputs to this logic scheme are an ALARM input 96 and a TROUBLE input 98 which are connected to an initial or first stage 100 which has connections to a start/stop latch device 102 at the upper left of the figure. The start/stop latch is in turn connected to a data input control latch 104, and to a ring counter 106. A clock generator 108, for supplying suitable clock pulses to the several blocks of the logic scheme, is seen to the right of the ring counter. It will also be seen, referring to the top left of FIG. 4, that a power supply 110 and a power-up reset device 112 are suitably connected to the various blocks of the logic scheme.

Before proceeding further with the description of the operation of the logic scheme, it is well to note that a plurality of so-called DIP switches 114 are provided in conjunction with the ring counter for coding purposes. Thus it will be appreciated that for any given alarm station these DIP switches can be suitably set so as to select an alarm code indicative of that station's location.

It will be understood, by reference to the table, that the various conditions, such as ALARM, TROUBLE, etc., are indicated simply by repeating the particular code from a given station. This will be explained more fully as the description proceeds.

Let it be assumed now that a particular condition arises: for example, that an ALARM condition arises at a particular station. The ALARM input 96 thereby becomes grounded or is otherwise set so as to cause the setting of alarm input latch 100A. When the output of the appropriate side of this device goes high, the result is that such output remains high even though the momentary alarm condition may terminate. Two things occur as a result of that output of such latch 100A going high: the output state so indicated affects the state of a round quantity decoder 116; in particular, the output from the latch 100A provides a signal which is transmitted along line 118 to an input of an AND gate 116A. This so conditions the output of stage 106A of the ring counter 106 as to terminate the count at the end of four rounds in this instance. At the same time that the aforesaid high output of the latch 100A conditions the AND gate 116A, a zero output on the other side of the latch 100A conditions, by way of line 119, a gate 120 not to decode a second round output. These particular rounds already referred to are indicated at the respective outputs of the devices 116A and 120. Also, a gate device 122 is provided and is suitably conditioned in respect to a single round.

At the same time that the set side of the latch 100A goes high, another result is that a positive level is put out from the one-shot device 123, the pulse output therefrom being transmitted by way of line 130 to an input of the upper side of start/stop latch 102. The consequence of this is that the reset line 132 acts to disable the several counters making up ring counter 106. As a result of this operation, the ring counter begins its counting operation. This reset line now being set to zero, the output from the inverter at the output stage, namely, inverter 140, is a "one" and this enables the clock generator to begin putting out clock pulses to the several stages of the ring counter 106. The last or output stage 106A of the ring counter counts through the 17 bits that make up the code and it functions to determine, for example, when four rounds have been transmitted. What happens is that each time the complete code has been counted, a shift register transmits the data input which is held at a constant one, or high level, and the 17th bit acts as a clock to that shift register and transfers that "1" to the several output lines designated 1, 2, 3, 4 at the lower right of the output stage 106A. The eventual result of the detection of the fourth round is that a positive pulse is transmitted on line 150 at the output of the output stage 116B of the decoder 116; this results in changing the state of the start/stop latch 102 with the result that the reset line is now reset to "1", thereby completely resetting and holding in a reset state the ring counter 106.

The alarm restoration operation is provided by the functioning of the resotration means at the lower part of FIG. 4, generally denominated 160. This arrangement results in putting out a start pulse on line 162—at the output of one-shot device 164—similar to the start pulse that was initiated at the output of one-shot 123 at the commencement of the alarm operation. This positive pulse on line 162 has the same effect as before at the start/stop latch 102, except that it now initiates the operation of the counting of a single round of code. At the same time, the one round decode gate 122 is enabled so as to detect this single round of code. Similarly to the case of the alarm mode, when that one round of code is detected, the output of gate 122 goes high and, again by way of line 150, causes the start/stop latch 102 to reset the reset line 132 to its high state.

Now let us assume that the alarm condition no longer exists, that the system has returned to a quiescent or normal state. Then further, assume that a trouble condition arises. This means that the TROUBLE input goes to ground with the consequence that the output of the trouble input latch 100B goes high. This causes similar conditioning as was the case before when there was an ALARM input. However, in this instance, the two-round gate 120 is conditioned on line 170 leading to the lowermost input of gate 120. At the same time—as before with the alarm mode—a start pulse is initiated on line 130 to the start/stop latch 102 which removes the reset on line 132 and enables the counter to begin its counting operation. Thus, the two-round gate 120 is conditioned to cause the gate 116B to have its output go high with the result that the reset goes high. As described before in the case of alarm restoration, another restoration operation is similarly commenced, by the same restoration means 160, after a trouble indication has been given and then the trouble disappears or is cured.

It will be understood by those skilled in the art that the other modes or combinations of modes as listed in the table are similarly effectuated by the logic arrangement of FIG. 4. In particular, the feature of the present invention by which the transmission of the alarm code is able to take precedence will now be explained. Let is be assumed that a TROUBLE condition exists initially and the ALARM condition does not exist. The trouble input latch 100B is thereby set by the TROUBLE condition, causing the output on line 170 to go high, and as a consequence to condition the round quantity decoder 120 to detect the end of the second round. At the same time, a start pulse is generated by one-shot device 123, and this pulse appears on output line 130 so as to initiate the sequence of events already described. However, if an alarm condition now arises before the code rounds corresponding to the trouble condition have been transmitted, the output of the latch 100A will go high, thereby causing output line 200 to go high; the result, because of the connection of inverter 202 in this line, is that the input to AND gate 204 goes low, thereby removing the conditioning of round quantity decoder 120 which was previously established, and thereby preventing this decoder from detecting the second round.

Since the ALARM input has become active, the sequence of events previously described will now take place, with the eventual result that the ring counter will stop the transmission at the end of four rounds. Accordingly, it will be appreciated that even though a TROUBLE input was initially present, the ALARM input immediately took precedence and brought about the transmission of a total of four rounds of code, thereby indicating the alarm condition.

In similar fashion, if the trouble had been merely momentary, the two rounds indicating the existence of trouble would have first been transmitted; then the single trouble restoration round would have been transmitted. Thereafter, if the alarm condition arose, four additional rounds would have been transmitted. This operation is in contrast to that achieved with mechanical transmitters which require manual activation of the trouble restoration mode. If manual restoration had not been so activated, the alarm mode would result in transmitting only three rounds, the one having already been used to indicate the trouble condition.

It should be noted that the individual relays, that is, relay K1 which is the code relay, and K2 the shunt relay (FIG. 4), are connected, respectively, to inverters 180 and 140, the latter inverter having already been mentioned. It will be appreciated that these individual relays will become energized as the code pulses are generated by the ring counter 106, such pulses being transmitted from decoder 115 at the outputs of the first and second stages 106B and 106C of this counter. Thus, each time an output pulse is received on line 184 from the output of decoder 115, it will cause momentary energization of the code relay K1. Accordingly, the code pulses will normally cause repetitive opening of the contacts K1A at the individual transmitters (FIG. 2). Likewise, the shunt relay contacts K2 will close in response to energization of relay K2 when an output is received as a consequence of the holding of the reset line.

What has been described is a code transmission system for transmitting a variety of coded signals from a plurality of transmitting stations to a central station for the purpose of indicating a fire alarm state or condition, or that there is trouble within certain parts of the system. Each station is assigned a code which can be programed by means of solid state logic devices in a logic arrangement or means especially adapted to repeat the individual code assigned to each station in accordance with the condition that has arisen; that is, according to whether an alarm condition, for example, or a trouble condition has arisen.

The code transmission system of the invention further involves a unique relay contact and diode arrangement that allows the multiple code transmitters to be operated over the same so-called McCulloh loop, such loop being per se well known for providing a technique of obtaining signals over circuits regardless of an open or ground condition for the circuits.

The system of the present invention eliminates the substantial coding ambiguities that have existed with mechanical code transmitters known in the art; moreover, because of the logic arrangement in accordance with the present invention, no resetting is required as is the case with mechanical transmitters. In addition, precedence is afforded for the alarm code over the trouble code such that there is no need to go through a mechanical cycle before shifting to the alarm code.

While there has been shown and described what is considered at present to be the preferred embodiment of the present invention, it will be appreciated by those skilled in the art that modifications of such embodiment may be made. It is therefore desired that the invention not be limited to this embodiment, and it is intended to cover in the appended claims all such modifications as fall within the true spirit and scope of the invention.

What is claimed is:

1. In a code transmission system which includes a central station, having a battery supply, and a plurality of station transmitters all of which are connected in a McCulloh loop circuit, having two lines, according to which an alarm may be received even though there may be a fault in the loop by using the remaining good leg of the circuit and ground return, the improvement which comprises:

at least one code relay forming a part of each of the station transmitters, said relay having three contacts, the first and second of which are in a series connection to ground from one of the lines forming said loop, the third contact of said relay being in shunt with the first and second contacts and also being connected to ground, the three contacts being so arranged that a normally closed loop is defined by the two lines when intact such that the battery supply is fed by way of the first line through said first contact, which is normally closed, and thence to said second line as a return line to the battery;

the second of said relay contacts being normally open and being operable to define a normally open loop when a fault occurs in said first line such that the positive battery supply is then connected to said second line and thence to ground; and said third contact being normally open and being operable to likewise define a normally open loop when a fault occurs in said second line such that the positive battery supply is then connected to said first line and thence to ground;

a diode in series connection with the first and second contacts of said one relay, and another diode in series connection with the third contact of the same relay.

2. In a code transmission system as defined in claim 1, another relay at each of the station transmitters, such relay having a pair of contacts for establishing a shunt connection between the transmitters.

3. In a code transmission system as defined in claim 1, further comprising a pair of relays having individual contacts at the central station, the first of said relays being a trouble relay having normally open contacts in a shunt connection between the first and second lines for establishing connection between the battery and said second line when the first line has a fault.

4. In a code transmission system as defined in claim 3, in which said other relay is an alarm relay having normally open contacts which close in the event of trouble and lock the trouble relay into its energized state.

5. A code transmission system, comprising a central station having a battery supply and a plurality of station transmitters, all of which are included in a MuCulloh loop circuit having two lines;

at least one code relay forming part of each of the station transmitters for transmitting a coded alarm over said loop circuit;

a solid state logic arrangement at each of the station transmitters, comprising switch means for selectively programming a variety of particular coded alarms for an individual station transmitter, said one code relay being connected to the output of said solid state logic arrangement;

said logic arrangement further comprising means for providing a prescribed number of rounds of said coded alarm in accordance with the condition sensed at the input of said logic arrangement, including means for counting the rounds and for terminating the transmission of the alarm code responsive to completion of the prescribed count.

6. A code transmission system as defined in claim 1, in which said means for selectively programming includes a ring counter having a plurality of stages, and in which said switch means includes switches at the outputs of said ring counter stages.

7. A code transmission system as defined in claim 5, further comprising means for enabling a particular condition at the input of the logic arrangement to take immediate precedence over a second condition, said means for enabling including means for detecting prescribed numbers of rounds corresponding to said second condition, and to said particular condition, and means for removing the control over the detection means by that second condition so that the particular condition which is to take precedence will control the detection means such that the detection means will proceed instead to detect the prescribed number of rounds corresponding to said particular condition.

8. A code transmission system as defined in claim 7, in which the particular condition is an alarm condition and the second condition is a trouble condition, and further in which there are included individual decoders for detecting the end of each of the rounds corresponding to the alarm and trouble conditions, a gate, and a latch means for sensing the presence of the alarm condition and for changing the condition of said gate so as to remove the conditioning of the decoder which serves to detect the number of rounds corresponding to the trouble condition such that the transmission of the code will not be terminated but will continue the transmission of the code so as to indicate the alarm condition.

* * * * *